US009821326B2

(12) United States Patent
Komaki et al.

(10) Patent No.: US 9,821,326 B2
(45) Date of Patent: Nov. 21, 2017

(54) PULSE SHOWER DEVICE

(71) Applicant: Lixil Corporation, Tokyo (JP)

(72) Inventors: Hideyuki Komaki, Tokyo (JP); Masaki Nishimura, Tokyo (JP)

(73) Assignee: Lixil Corporation, Tokyo (JP)

( * ) Notice: Subject to any disclaimer, the term of this patent is extended or adjusted under 35 U.S.C. 154(b) by 0 days.

(21) Appl. No.: 14/762,624

(22) PCT Filed: Jan. 17, 2014

(86) PCT No.: PCT/JP2014/050819
§ 371 (c)(1),
(2) Date: Jul. 22, 2015

(87) PCT Pub. No.: WO2014/115656
PCT Pub. Date: Jul. 31, 2014

(65) Prior Publication Data

US 2015/0367355 A1 Dec. 24, 2015

(30) Foreign Application Priority Data

Jan. 24, 2013 (JP) ..... 2013-011553

(51) Int. Cl.
*B05B 1/18* (2006.01)
*B05B 3/04* (2006.01)
*B05B 1/08* (2006.01)

(52) U.S. Cl.
CPC ..... *B05B 1/185* (2013.01); *B05B 1/083* (2013.01); *B05B 1/18* (2013.01); *B05B 3/04* (2013.01)

(58) Field of Classification Search
CPC ..... B05B 1/185; B05B 1/083; B05B 1/18
USPC ..... 239/381–383
See application file for complete search history.

(56) References Cited

U.S. PATENT DOCUMENTS 4,131,233 A * 12/1978 Koenig ..... B05B 1/1609 239/381
4,141,502 A * 2/1979 Grohe ..... B05B 3/04 239/381

(Continued)

FOREIGN PATENT DOCUMENTS

DE 102008015969 A1 9/2009
JP 59151958 A 8/1984

(Continued)

OTHER PUBLICATIONS

International Search Report issued in International Patent Application No. PCT/JP2014/050819, mailed Apr. 15, 2014, 2 pages.

(Continued)

*Primary Examiner* — Chee-Chong Lee
(74) *Attorney, Agent, or Firm* — Wood, Herron & Evans LLP

(57) ABSTRACT

A pulse shower device including a water dispersion plate and an impeller is provided. The water dispersion plate includes an inner surface and an outer surface, and a plurality of shower holes that are provided from the water surface to the outer surface. The impeller includes shower hole blocking portions that are formed over a predetermined circumferential length along the inner surface in a downstream portion of the inner surface of the water dispersion plate, and or the plurality of shower holes; shower hole opening portions that open toward the inner surface; a plurality of vanes; an inner peripheral portion; and an outer peripheral portion. The impeller is provided on an upstream portion of the inner surface of the water dispersion plate, and rotates around an axis due to a water stream hitting the vanes.

1 Claim, 17 Drawing Sheets

(56) References Cited

U.S. PATENT DOCUMENTS

| | | | | | |
|---|---|---|---|---|---|
| 4,254,914 | A | * | 3/1981 | Shames | B05B 1/1636 239/222.17 |
| 4,398,668 | A | * | 8/1983 | Jette | B05B 1/3026 137/625.41 |
| 4,412,834 | A | * | 11/1983 | Kulin | A61M 39/16 137/625.41 |
| 4,478,367 | A | * | 10/1984 | Petursson | B05B 1/1636 239/381 |
| 4,629,125 | A | * | 12/1986 | Liu | B05B 1/1636 239/383 |
| 4,801,091 | A | | 1/1989 | Sandvik | |
| 2010/0127096 | A1 | | 5/2010 | Leber | |

FOREIGN PATENT DOCUMENTS

| | | | |
|---|---|---|---|
| JP | 01297162 | A | 11/1989 |
| JP | 05115520 | A | 5/1993 |
| JP | 2012135606 | A | 7/2012 |

OTHER PUBLICATIONS

Japanese Patent Office, Notice of Allowance issued in corresponding Japanese Patent Application No. 2013-011553 and English-language translation mailed Jan. 5, 2016.

European Patent Office, Extended European Search Report issued in corresponding European Patent Application No. 14743143.1 dated Jan. 7, 2016.

* cited by examiner

A-A CROSS-SECTION

B-B CROSS-SECTION

PULSE SHOWER DEVICE

TECHNICAL FIELD

The present invention relates to a pulse shower device that intermittently discharges water in pulses from shower holes.

Priority is claimed on Japanese Patent Application No. 2013-011553, filed Jan. 24, 2013, the content of which is incorporated herein by reference.

BACKGROUND ART

In the related art, pulse shower devices, which intermittently discharge water in pulses from shower holes by intermittently blocking and opening the shower holes, are well-known.

General pulse shower device's include a water dispersion plate including a plurality of shower holes that are provided from an inner surface to an outer surface, and an impeller that is provided on an upstream side of the inner surface of the water dispersion plate and rotates around an axis due to a water stream hitting vanes. The impeller includes, alternately in the circumferential direction, a shower hole blocking portion that extends over a predetermined circumferential length along the inner surface of the water dispersion plate in a downstream portion of an inner surface portion of the water dispersion plate and covers the shower holes, and as shower hole opening portion that opens toward the inner surface of the water dispersion plate.

In the above pulse shower devices, the shower hole blocking portion and the shower hole opening portion are rotationally moved around the axis through the rotation of the impeller, the shower holes are intermittently blocked and opened, and water is intermittently discharged in pulses from the shower holes.

For example, the following Patent Document 1 discloses a shower head including a cap (water dispersion plate) 70 having jet holes (shower holes) 74, and an impeller 56 on an upstream side of the cap. The impeller 56 includes a cover plate 60 as a shower hole blocking portion over a semicircle, and a shower hole opening portion over the remaining semicircle. The impeller 56 is rotationally moved by the action of a water stream to vanes 57, the cover plate 60 as the shower hole blocking portion and the shower hole opening portion are rotationally driven around an axis, the shower holes are intermittently blocked and opened, and water is intermittently discharged in pulses.

Additionally, the following Patent Document 2 discloses a water discharge device including a water dispersion plate 58 having shower holes 118, and an impeller 124 on an upstream side of the cover dispersion plate. The impeller 124 includes a shower hole blocking portion 130 over a semicircle, and a shower hole opening portion over the remaining semicircle. The shower hole blocking portion 130 and the shower hole opening portion are rotationally moved around an axis through the rotation of the impeller 124, the shower holes 118 are intermittently blocked and opened, and water is intermittently discharged in pulses.

In either of Patent Document 1 and Patent Document 2, a portion used as the water dispersion plate of a pulse shower device (device that intermittently discharges water through the rotation of the impeller) is only a portion on the inner peripheral side of the entire water dispersion plate of the shower head, the water dispersion plate (specifically, the portion used as the shower device in detail) and the impeller have smaller diameters, and the pulse shower device itself is small-sized.

In contrast, when the pulse shower device is enlarged, for example, when the entire larger-diameter water dispersion plate of the shower head up to an outer peripheral portion thereof is used as the water dispersion plate of the pulse shower device, the impeller is made to have a larger diameter with an increase in the diameter of the water dispersion plate, and thereby, when the pulse shower device is enlarged, a sensation while showering in water deteriorates if the shape of the small (small-diameter) impeller is merely made large (made to have a larger diameter) as it is.

For example, when the shape of a small-diameter impeller in which a half peripheral portion is formed as the shower hole blocking portion and the remaining half peripheral portion is formed as the shower hole opening portion is made to have a larger diameter as it is, a user feels that showering, in a shower has worsened. Specifically, a pulsating sensation of the water that is intermittently discharged becomes strong.

This is considered to be based on the following reasons. Hereinafter, descriptions will be made with reference to schematic views of FIGS. 13A and 13B.

In FIG. 13A, a small-sized pulse shower device 205A includes a small-diameter impeller 200A, a shower hole blocking portion 202A and a shower hole opening portion 204A that are provided in the impeller 200A, and water spray holes 206 provided in a water dispersion plate.

In FIG. 13B, in a large-sized pulse shower device 205B, a larger-diameter impeller 200B includes as shower hole blocking portion 202B and a shower hole opening portion 204B that are provided in the impeller 200B, and water spray holes 206 provided in a water dispersion plate.

In the small-sized pulse shower device 205A, attention is paid to shower holes 206*a* that are in a blocked state due to the shower hole blocking portion 202A. The shower holes 206*a* are brought into the blocked state for $t_1$ seconds during the rotation of the impeller 200A, and are brought into an open state for $t_2$ seconds ($t_1=t_2$) after that.

The same applies to shower holes 206*a* of the inner peripheral portion of the large-sized pulse shower device 205B. That, is the time for which the shower holes are brought into the blocked state by the shower hole blocking portion 202B is $t_1$ seconds, and the time for which the shower holes are brought into the open state by the shower hole opening portion 204B is $t_2$ seconds.

If attention is paid to shower holes 206*b* and 206*c* of the outer peripheral portion of the large-sized pulse shower device 205B, the circumferential length of the outer peripheral portion of the shower hole blocking portion 202B that acts to block the shower holes 206*b* and 206*c* is greater than the circumferential length of the shower hole blocking portion 202A in the small-sized pulse shower device 205A. Nevertheless, the time for which the shower holes are brought into the blocked state by the shower hole blocking portion 204B is $t_1$ seconds, and the time for which the shower holes are brought into the open state by the shower hole opening portion 204B is $t_2$ seconds. That is, this is the same as in the case of the shower holes 206*a*.

If both of the rotational frequency of the impeller 200A of the small-sized pulse shower device 205A and the rotational frequency of the impeller 200B of the large-sized pulse shower device 205B are both $n_1$, only the circumferential speed of the portion on the outer peripheral side of the shower hole blocking portion 202B becomes faster than the circumferential speed of the shower hole blocking portion 202A, but the rotating speeds (the rotational frequencies) are the same. Therefore, the time interval it takes until the shower holes are brought into the open state from the blocked state and brought into the blocked state from the open state are the same not only in the shower hole 206*a* but also in the shower holes 206*b* and 206*c*.

Nevertheless, in the case of the large-sized pulse shower device 205B, a user feels that the time interval taken until the water is switched from being blocked to being able to flow freely and from being able to flow freely to being blocked is physically felt as being longer, a pulsating sensation is strong, and a user's sensation while showering in water deteriorates.

The following reason is mentioned as one reason. That is, even if the positions of the holes from which water flow out vary in the portion of the water dispersion plate on the inner peripheral side, all the shower holes are in a small area of the inner peripheral portion. Therefore, a user does not feel the variation very strongly in terms of physical sensation. Meanwhile, in the portion on the outer peripheral side, an area in which the shower holes are present is large, and the number of shower holes is also large. Therefore, a poor distribution between each of a region from which water flow out and a region from which water does not flow out is strong. Therefore, a strong movement of the region from which shower flow out and the region from which water does not flow out is felt, and this leads to a strong pulsating sensation of water.

In the pulse shower devices that intermittently discharge water, it is necessary to give a pulsating sensation. On the other hand, a too strong pulsating sensation deteriorates the showering feeling. Therefore, there is demand for improvement.

PRIOR ART DOCUMENTS

Patent Documents

[Patent Document 1] Japanese Unexamined Patent Application, First Publication No. H5-115520

[Patent Document 2] Japanese Unexamined Patent Application, First Publication No. 2012-135606

DISCLOSURE OF INVENTION

Problems to be Solved by the Invention

The invention has heel made in view of the above circumstances, and provides a pulse shower device that intermittently discharges water, which can ensure. excellent showering feeling even in a case where the pulse shower device is enlarged.

Means for Solving the Problems

According to a first aspect of the present invention, there is provided a pulse shower device including a water dispersion plate that includes an inner surface and an outer surface, and a plurality of shower holes that penetrate from the inner surface to the outer surface, and an impeller that includes a shower hole blocking portion that is formed over a predetermined circumferential length along the inner surface in a downstream portion of the inner surface of the water dispersion plate, and covers the plurality of shower holes; a shower hole opening portion that opens toward the inner surface; a plurality of vanes; an inner peripheral portion; and an outer peripheral portion, that is provided on an upstream portion of the inner surface of the water dispersion plate, and that rotates around an axis due to a water stream hitting the vanes. The shower hole blocking portion and the shower hole opening portion are alternately arranged in a circumferential direction on the same circumference, and rotate around the axis through the rotation of the impeller to intermittently block and open the shower holes, and intermittently discharge water in pulses from the shower holes. The number of shower hole blocking portions and shower hole opening portions that are arranged on the same circumference at the outer peripheral portion is greater than the number of shower hole blocking portions and shower hole opening portions at the inner peripheral portion, and at time interval from the blocking of the shower holes at the outer peripheral portion to the closing thereof and from the opening thereof to the blocking thereof is shorter than as time interval from the blocking of the shower holes at the inner peripheral portion to the closing thereof and from the opening thereof to the blocking thereof.

According to a second aspect of the present invention, in the pulse shower device of the first aspect described above, it is preferable that the ratio of the circumferential length of the shower hole blocking portion and the shower hole opening portion arranged on the same circumference to the whole circumferential length is smaller at the outer peripheral portion than the inner peripheral portion.

According to a third aspect of the present invention, in the pulse shower device of the first or second aspect described above, it is preferable that the ratio of the circumferential length of the shower hole blocking portion and the shower hole opening portion arranged on the same circumference to the whole circumferential length is equal to or higher than 0.04.

Effects of the Invention

According to the aspects of the present invention described above, in the pulse shower device that rotationally moves the shower hole blocking portion and the shower hole opening portion around the axis through the rotation of the impeller, intermittently blocks and opens the shower holes, and intermittently discharges water from the shower holes, the number of shower hole blocking portions and shower hole opening portions that are arranged on the same circumference is greater at the outer peripheral portion than at the inner peripheral portion, and the time interval from the blocking of the shower holes at the outer peripheral portion to the closing thereof and from the opening thereof to the blocking thereof is shorter than the time interval at the inner peripheral portion. In the invention, a pulsating sensation of water is relaxed even in a case where the pulse shower device is enlarged, and a sensation while showering in water is prevented from deteriorating due to an excessively strong pulsating sensation of the water. Accordingly, a user can be made to feel a comfortable sensation while showering in a shower.

EMBODIMENTS FOR CARRYING OUT THE INVENTION

An exemplary embodiment of the invention will be described in detail with reference to the drawings.

Figure 1:
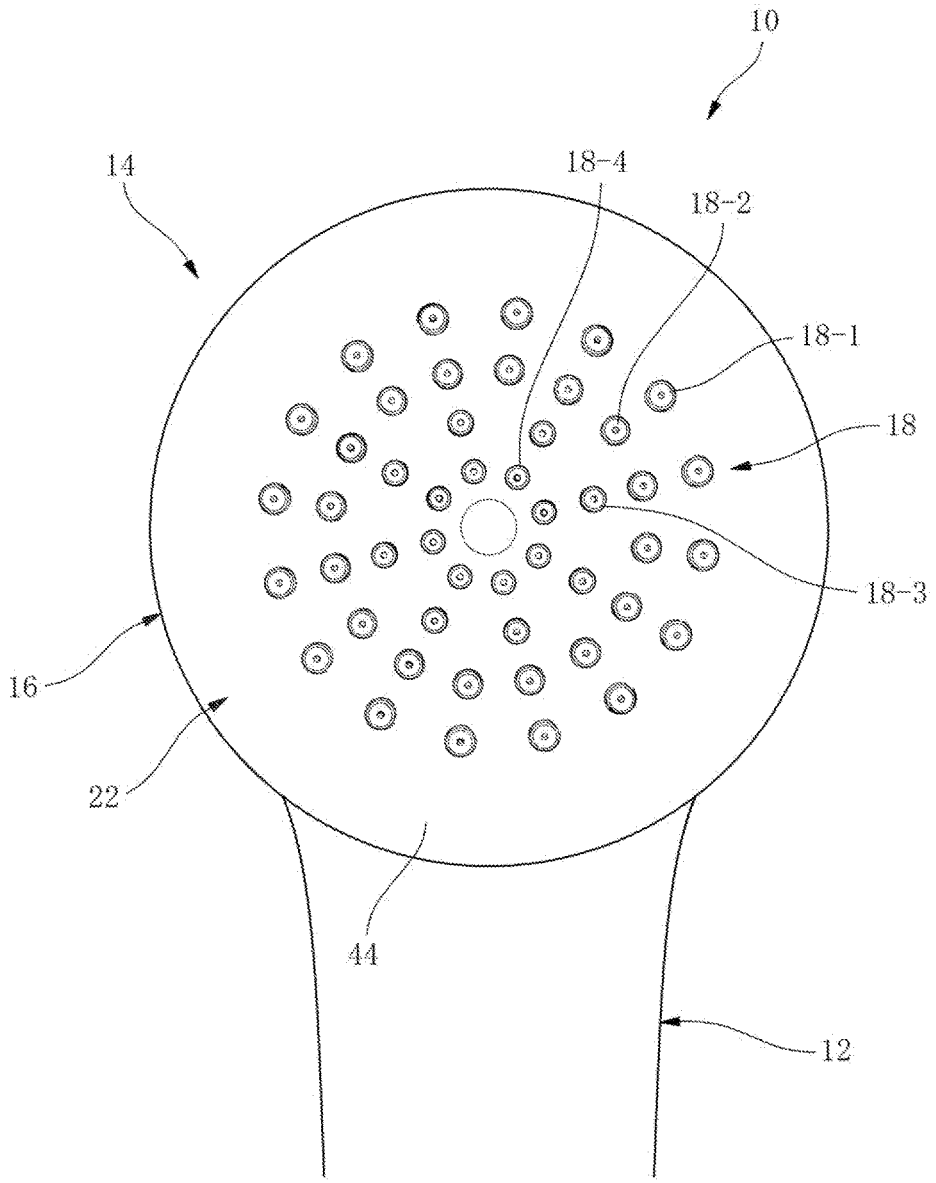
FIG. 1 is a view showing a shower head according to an exemplary embodiment of the invention.

In FIG. 1, a shower head (pulse shower device) 10 includes a grip part 12, a head part 14, and a water dispersion plate 16 provided in the had part 14.

A large number of shower holes 18 that penetrate from an inner surface to an outer surface (lower surface) are provided in the water dispersion plate 16 so as to form four concentric circles.

Shower holes 18-1 at the outermost periphery of the concentric circles, shower holes 18-2 further inwards from the shower holes 18-1, shower holes 18-3 further inwards thereof, and shower holes 18-4 at the innermost periphery thereof are respectively shown in the drawing.

Figure 2:
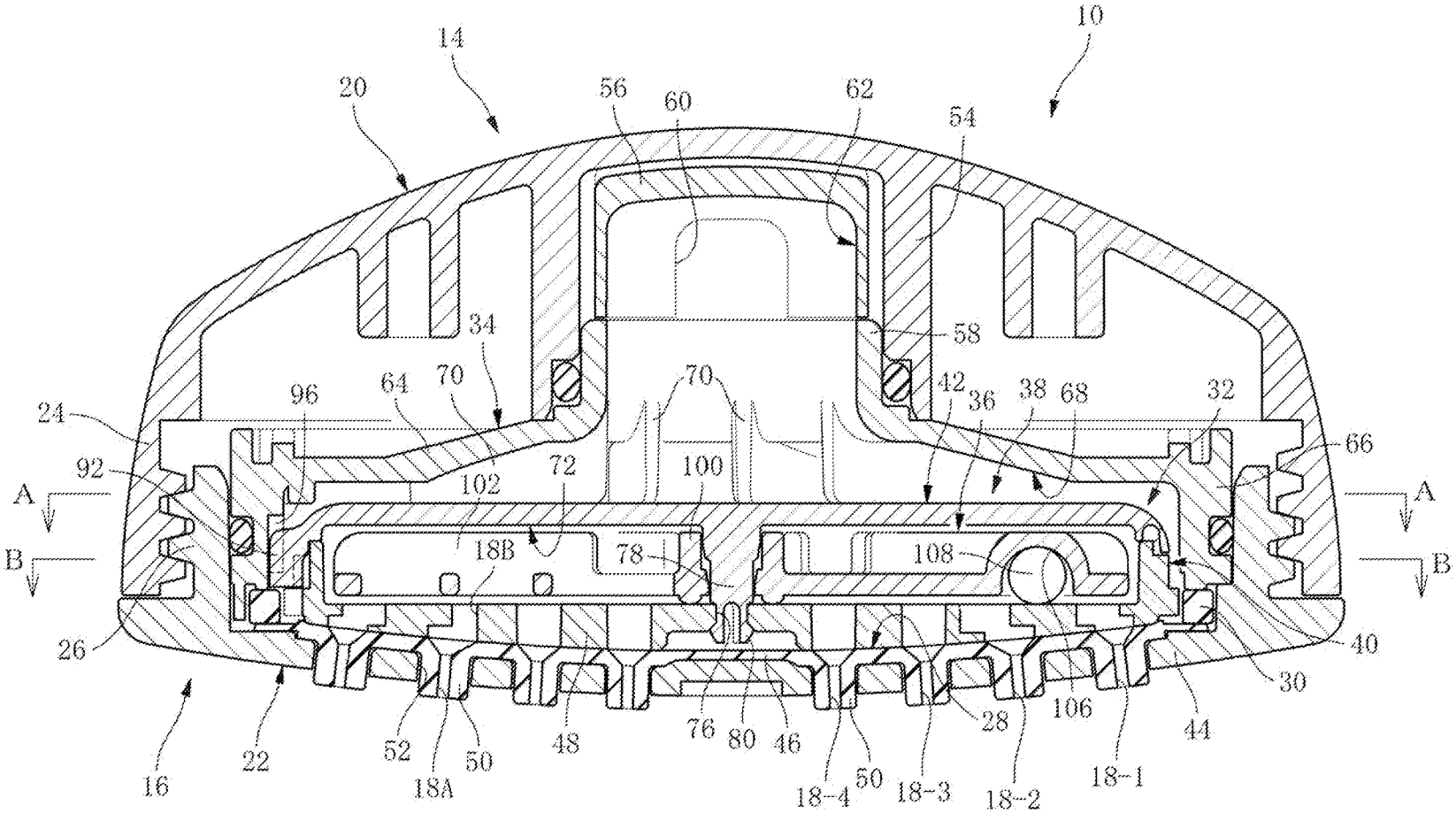
FIG. 2 is a view showing the internal structure of the shower head of FIG. 1.

The internal structure of the head part 14 of the shower head 10 is specifically shown in FIG. 2.

As shown in FIG. 2, the head part 14 of the shower head 10 has an upper case 20, and a cap 22 that is a lower case that closes an opening at a lower end (in the drawing) of the upper case 20.

The upper case 20 has a cylindrical peripheral wall portion 24 that is provided with a female thread portion (not shown).

Meanwhile, the cap 22 has a cylindrical rising portion 26 that is provided with a male thread portion (not shown).

The cap 22 is screw-coupled to the upper case 20 by the male thread portion and the female thread portion.

The internal structure of the head part 14 is shown in detail in FIGS. 2 to 5.

Figure 4:
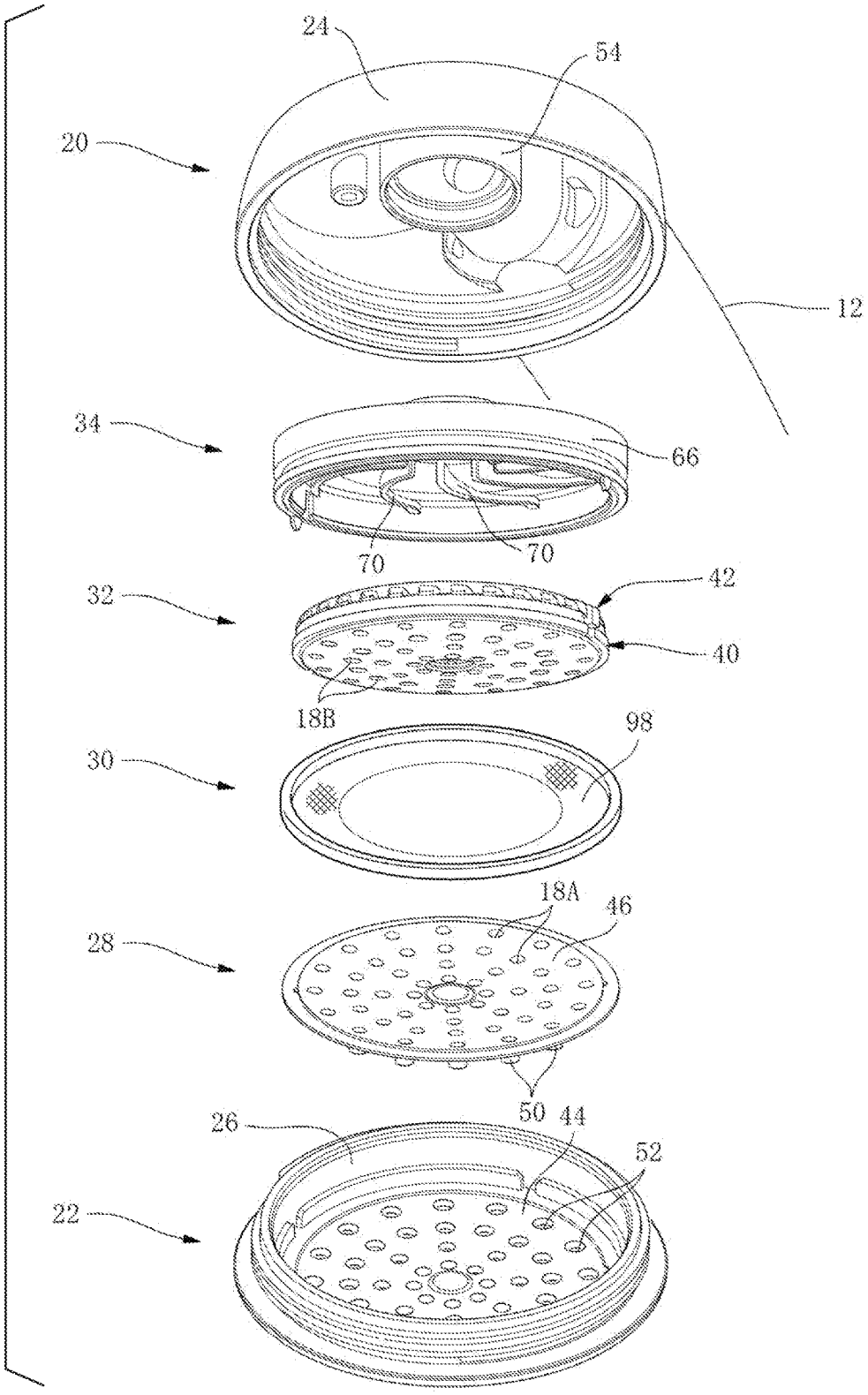
FIG. 4 is a perspective view showing constituent portions of the shower head of FIG. 2 in a disassembled manner.
Figure 5:
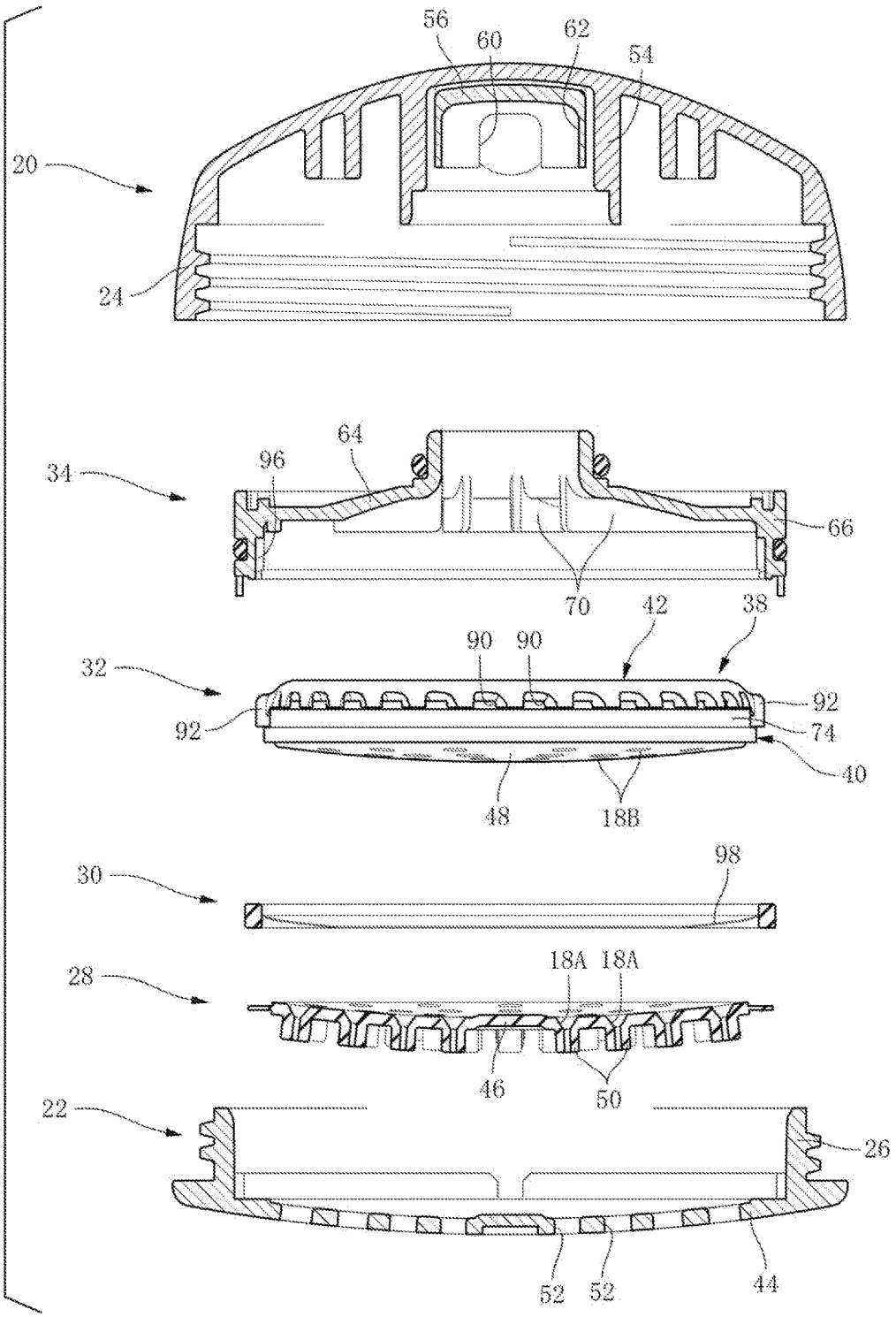
FIG. 5 is a sectional view of the constituent portions of the shower head shown in FIG. 4.

As shown in FIGS. 2, 4, and 5, as nozzle seat 28, a ring-shaped packing 30, an impeller unit 32, and as spiral flow generating member 34 are included inside the head part 14.

Figure 3:
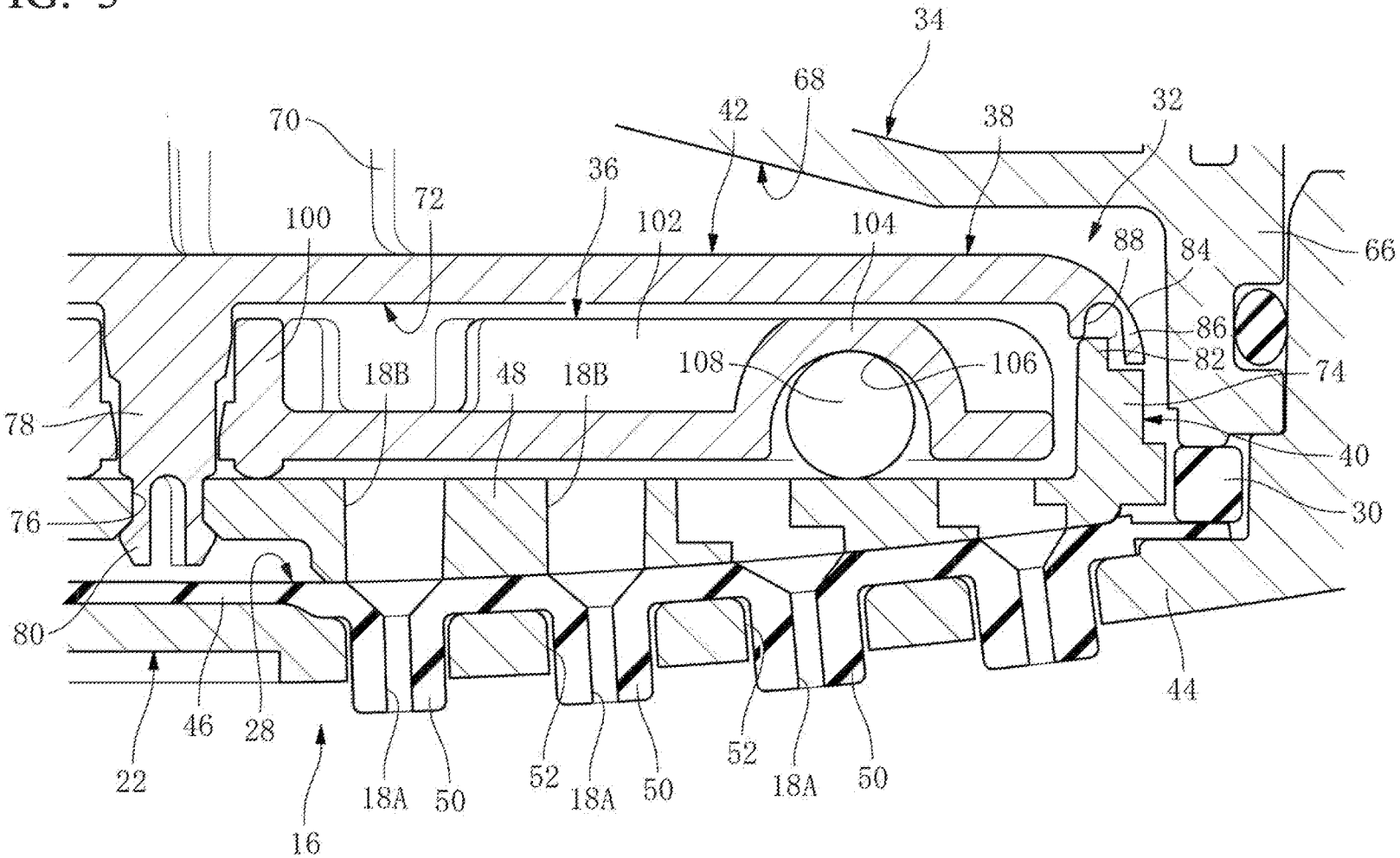
FIG. 3 is a further enlarged view of essential parts of FIG. 2.

The impeller unit 32, as shown in FIGS. 2 and 3, has an impeller 36, and an impeller housing 38 that houses the impeller 36 therein.

Additionally, the impeller housing 38 is constituted of a main housing body 40 that serves as a nozzle seat retainer, and a lid body 42.

In the present exemplary embodiment, other respective members excluding the nozzle seat 28 and the packing 30, specifically, all of the upper case 20, the cap 22, the impeller 36 of the impeller unit 32, the impeller housing 38, and the spiral flow generating member 34 are made of hard resin.

In the present exemplary embodiment, the water dispersion plate 16 is configured to have a three-fold stacked structure of a bottom portion 44 of the cap 22, a seat portion 46 of the nozzle seat 28 superposed on the bottom portion 44, and a bottom portion 48 of the main housing body 40 further superposed on the seat portion 46.

Although the nozzle seat 28 is made of rubber, the nozzle seal may be made of other elastomer materials. The nozzle seat 28 has the seat portion 46, and a plurality of nozzle portions 50 that protrude downward (downward direction in the drawing) from the seat portion 46. The respective nozzle portions 50 are inserted through insertion holes 52 formed in the bottom portion 44 of the cap 22 made of resin, and respective tip portions thereof protrude downward.

The plurality of nozzle portions 50 have nozzle holes 18A therein, respectively, and lower portions of the shower holes 18 are formed by the nozzle holes 18A. The diameter of the nozzle holes 18A is Φ0.8 mm.

The seat portion 46 of the nozzle seat 28, as shown in FIGS. 3 and 4, has a curved shape such that a lower surface thereof in the drawing become convex downward and an upper surface thereof in the drawing becomes concave downward, and the respective nozzle portions 50 having a shape that fills perpendicularly from the lower surface of the seat portion 46 are integrally formed in the seat portion 46.

In correspondence with the above shape, a lower surface of the main housing body 40 that serves as the above nozzle retainer forms a convex surface corresponding to the concave surface of the seat portion 46 of the nozzle seat 28.

A large number of communication holes 18B that communicates with the nozzle holes 18A and form upper portions of the shower holes 18 are provided in the bottom portion 48 of the main housing body 40 so as to pass through the bottom portion 48.

In FIG. 2, a cylindrical portion 54 is provided at to central portion of the upper case 20, and a water channel forming member 56 that has a bottomed cylindrical shape and is made of resin is assembled into the cylindrical portion 54.

Additionally, a cylindrical portion 58 that rises upward at a central portion of the spiral flow generating member 34 is inserted into the cylindrical portion 54. An inflow chamber 62 into which the water from the water channel 60 is made to flow is formed inside the cylindrical portion 54 by the water channel forming member 56 and the cylindrical portion 58.

The spiral flow generating member 34 inclines gently downward in an outer circumferential direction from the center thereof, and has an upper wall portion 64 that has a flat shape which widens in a direction perpendicular to an axis (axis-perpendicular direction) thereof, and a cylindrical peripheral wall portion 66 that falls downward at an outer peripheral end of the upper wall portion 64. A water chamber 68 configured to generate a spiral flow is formed between the upper wall portion 64 and the lid body 42 of the impeller housing 38.

The spiral flow generating member 34 is provided with stationary vanes 70 that fall from the upper wall portion 64 and extend in a partial spiral shape from an inner peripheral end toward an outer peripheral end, and the stationary vanes 70 abut against an upper surface of the lid body 42 of the impeller housing 38.

The spiral flow generating member 34 changes the flow of the water, which has flowed into the inflow chamber 62 from the water channel 60 and has further flowed in an axial direction in a downward direction (in the drawing) of the inflow chamber 62, in the axis-perpendicular direction, and makes the water flow to an outer peripheral side.

In that case, the flow of the water that flows in the axis-perpendicular direction toward the outer peripheral side due to the flow straightening and the guidance action of the stationary vanes 70 that have the partial spiral shape is used as the spiral flow, and the spiral flow is made to abut against the cylindrical peripheral wall portion 66.

Thereafter, the flow of the water that has abutted to the peripheral wall portion 66 is reversed in direction, and becomes an inward flow in the axis-perpendicular direction, and the water flows into the impeller housing 38 of the impeller unit 32 vigorously.

The impeller unit 32 forms a water chamber 72 inside the impeller housing 38, and the impeller 36 is rotatably housed in the water chamber 72.

The impeller housing 38 is divided into the main housing body 40 and the lid body 42 as described above, and the main housing body 40 is configured to serve also as the nozzle retainer.

The main housing body 40 is a member that has a cylindrical peripheral wall portion 74 and a bottom portion 48 and opens at an upper end thereof, and the opening portion of the upper end thereof is closed by the lid body 42.

A fixing hole 76 passing through the bottom portion 48 is provided at a central portion of the bottom portion 48 of the main housing body 40.

The lid body 42 is provided with a shaft portion 78 that falls from a central portion thereof. An elastic claw 80 is further provided at a lower portion of the shaft portion 78, and the elastic claw 80 is inserted into the fixing hole 76 of the main housing body 40 and is elastically latched to the fixing hole 76. The lid body 42 and the main housing body 40 are assembled together by latching of the elastic claw 80 to the fixing hole 76.

Figure 6:
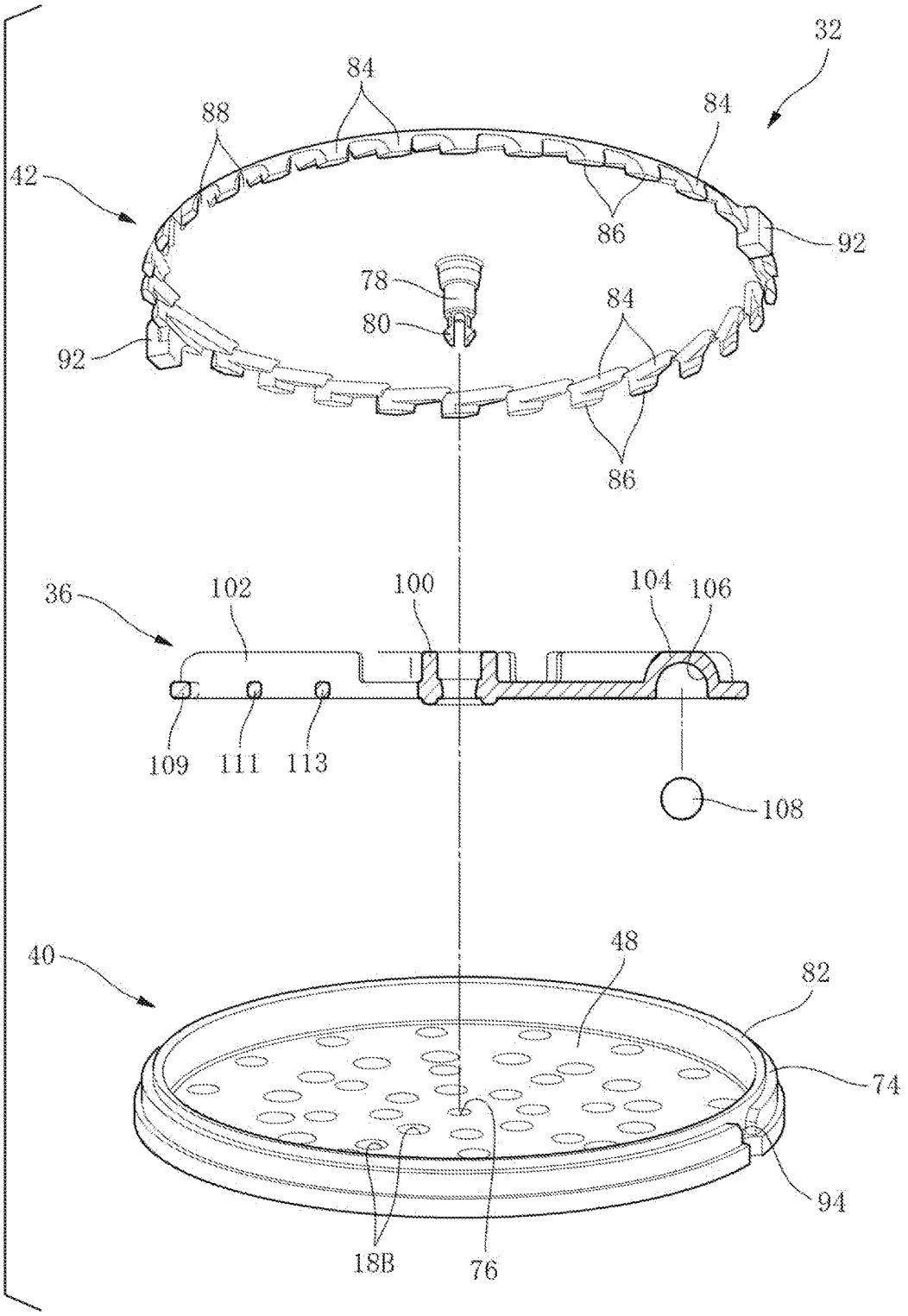
FIG. 6 is a view showing an impeller unit of FIG. 4 in a further disassembled manner.
Figure 7A:
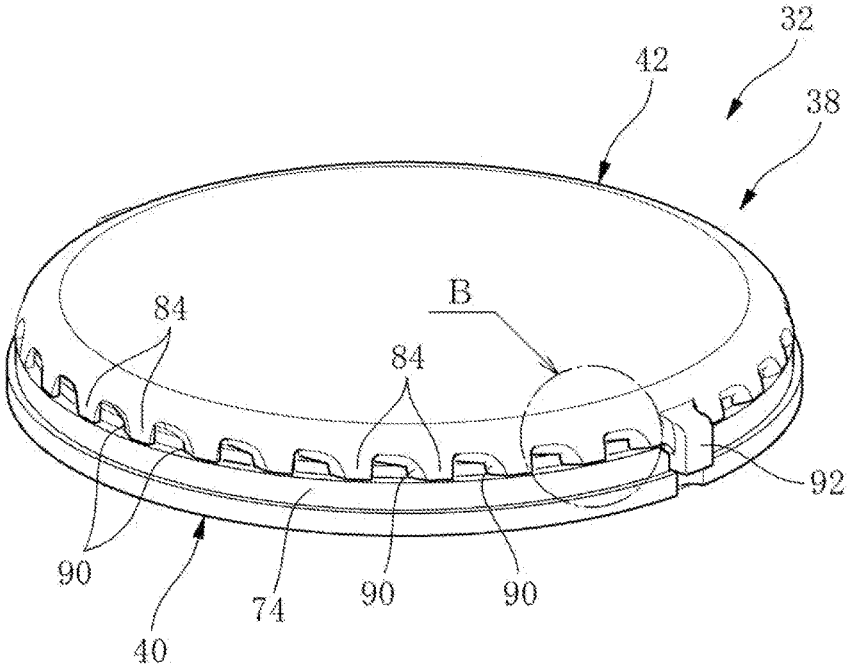
FIG. 7A is a view showing the impeller unit of FIG. 4 in an assembled state.
Figure 7B:
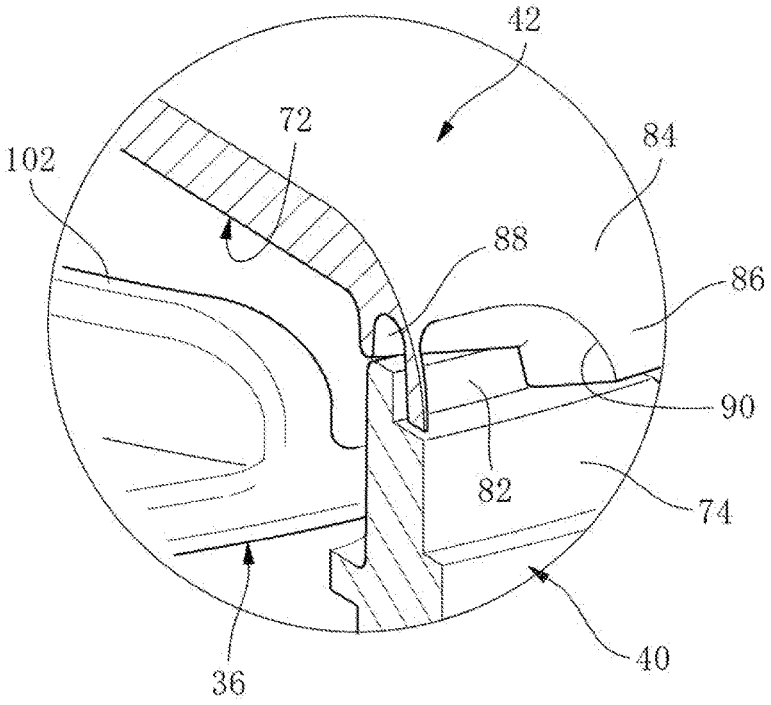
FIG. 7B is an enlarged view of part B of FIG. 7A.

As shown in FIGS. 6, 7A, and 7B, an inner fitting portion 82, which protrudes upward (in the drawing) in a stepped shape with respect to an outer peripheral portion and forms an annular shape in a circumferential direction, is provided at an upper end portion and an inner peripheral portion of the peripheral wall portion 74 of the main housing, body 40.

An outer peripheral portion of the lid body 42 is provided with bend portions 84 that have a downward bent shape (in the drawing).

Outer peripheral portions of the bend portions 84 are annular outer fitting portions 86, and the outer fitting portions 86 are fitted to the inner fitting portion 82 of the main housing body 40 in an external fitting state.

A larger number of spray ports 88 are provided at regular intervals in the circumferential direction in the bend portions 84 of the lid body 42, and allow a water stream, which has abutted against the peripheral wall portion 66 of the spiral flow generating member 34 and of which the direction has been reversed inward, to pass therethrough toward the water chamber 72 within the impeller housing 38.

The water stream that has passed through the spray ports 88 becomes a sprayed water stream and rotationally drives the impeller 36 within the water chamber 72, specifically, hits vanes 102 vigorously and rotationally drives the impeller 36.

The spray ports 88 open in outer surfaces of the bend portions 84. An opening 90 is shown in FIG. 7B.

Figure 11A:
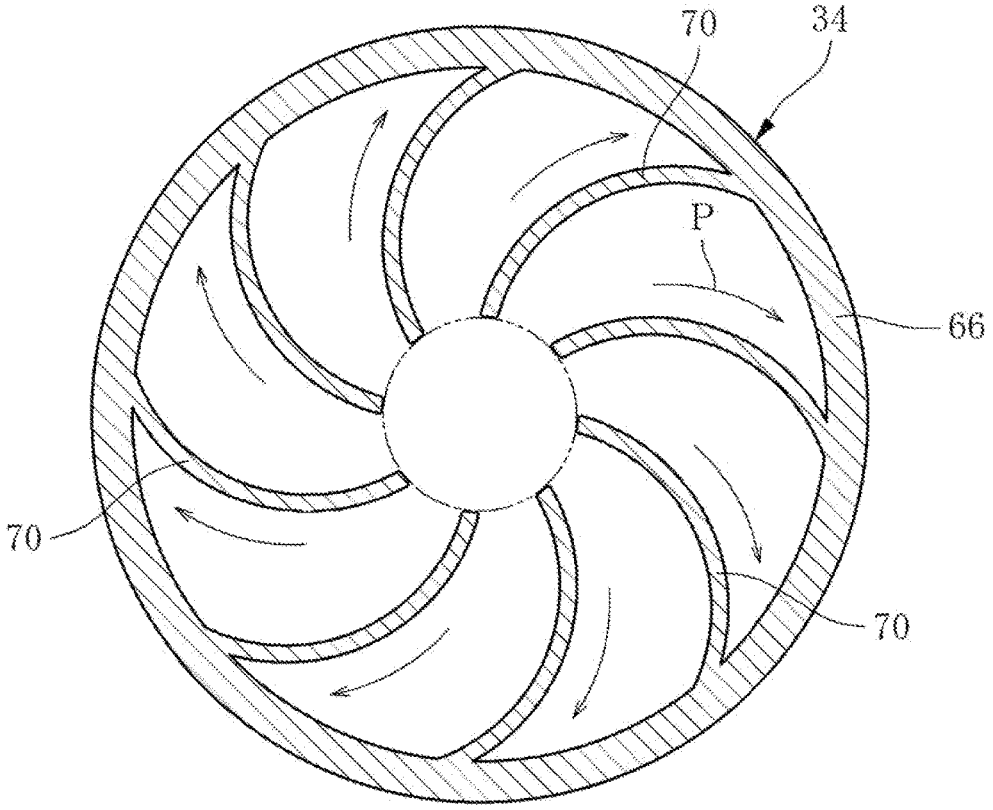
FIG. 11A is an A-A sectional view of FIG. 2.
Figure 11B:
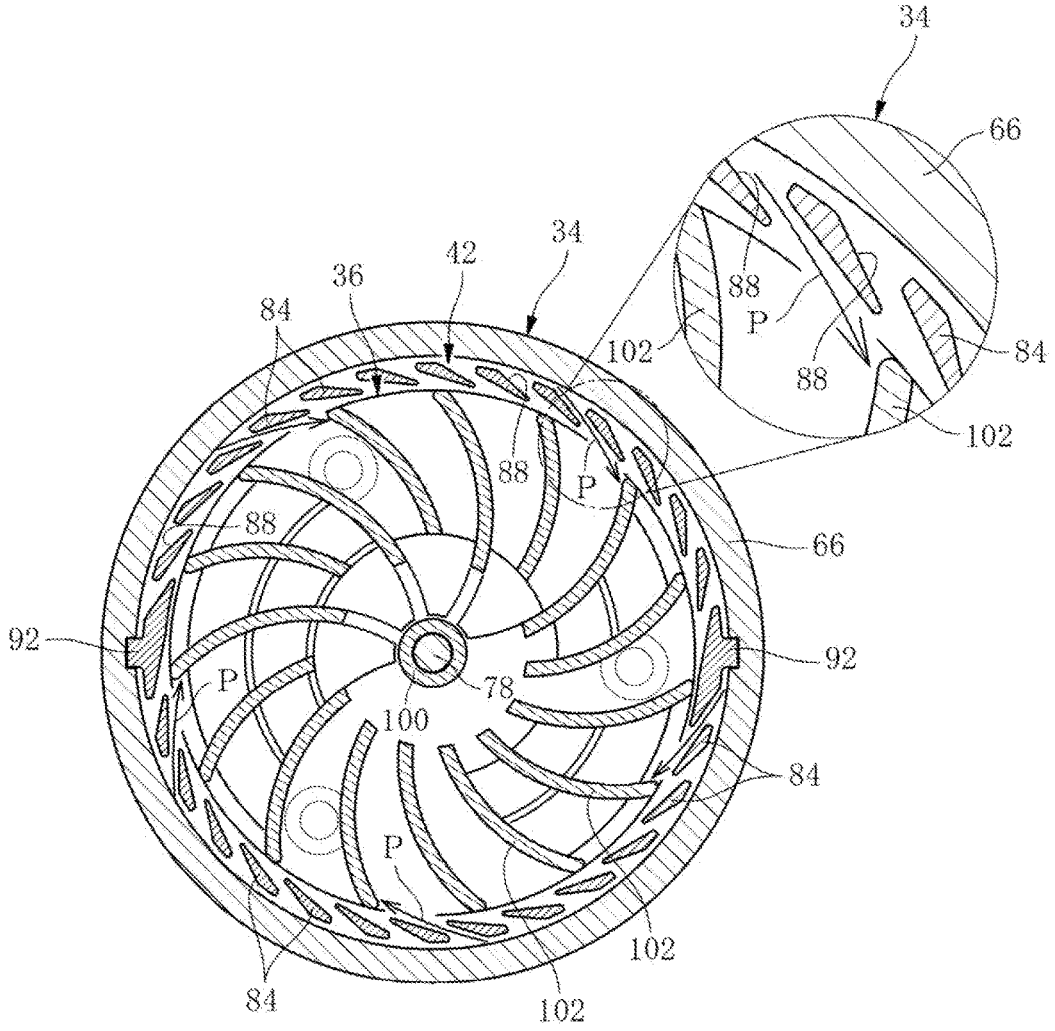
FIG. 11B is a B-B sectional view of FIG. 2.

The spray ports 88, as shown in FIG. 11B, are inclined with respect to the circumferential direction of the bend portions 84 of the lid body 42 and the peripheral wall portion 74 of the main housing body 40.

The inclination direction of the spray ports 88 is determined such that the water stream, which has hit the peripheral wall portion 66 of the spiral flow generating member 34 while generating a spiral stream and of which the direction has been reversed inward, is sprayed to the impeller 36 within the water chamber 72 while the spiral flow is maintained.

As is clear from the above descriptions, in the present exemplary embodiment, the impeller housing 38, specifically, the lid body 42 is constituted as to water stream spraying member that passes the water from an upstream portion therethrough, causes the passed water to collide against the impeller 36 as the sprayed water stream, and rotationally drives the impeller 36.

In addition, as shown in FIG. 6, positioning convex portions 92 are provided in two places, which are separated by 180° in the circumferential direction, on the lid body 42.

Positioning concave portions 94 are provided at positions corresponding to the positioning convex portions 92 in the peripheral wall portion 74 of the main housing body 40.

The lid body 42 and the main housing body 40 are positioned in the circumferential direction by the concavo-convex fitting between the positioning convex portions 92 and the positioning concave portions 94.

Figure 8:
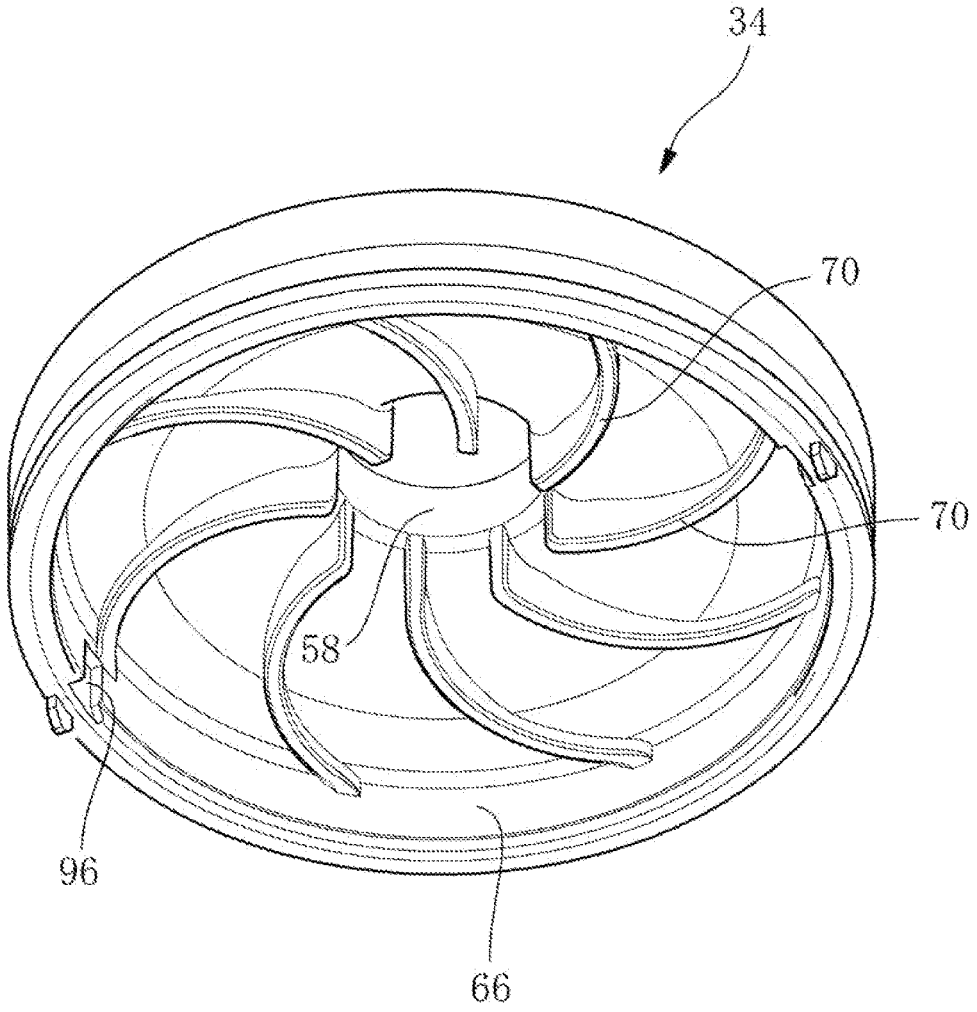
FIG. 8 is a view showing a spiral flow generating member of FIG. 4 from a different direction.

As shown in FIG. 8, positioning concave portions 96 are similarly provided also in the spiral flow generating member 34. The lid body 42 and the spiral now generating member 34 are positioned in the circumferential direction on the basis of the concavo-convex fitting of the positioning convex portions 92 of the lid body 42 into the positioning concave portions 96. That is, the impeller housing 38 is positioned in the circumferential direction with respect to the spiral flow generating member 34.

In addition, in the present exemplary embodiment, if the cap 22 is screwed into the upper case 20 upward in FIG. 2, the spiral flow generating member 34 is pushed upward (in the drawing) via the ring-shaped packing 30. Then, the spiral flow generating member is fixed and assembled so as to abut against the cylindrical portion 54 of the upper case 20.

In this case, the impeller housing 38 of the impeller unit 32 hits the stationary stationary vanes 70 of the spiral flow generating member 34, and is sandwiched together with the bottom portion 44 of the cap 22, whereby the impeller housing 38 is fixed.

In this case, a downward force is applied from the main housing body 40, which also serves as the nozzle retainer, to the nozzle seat 28 by a sandwiching force, and the nozzle seat 28 is pressed against the bottom portion 44 of the cap 22 downward.

In addition, in FIG. 4, the ring-shaped packing 30 is provided with an annular seat 98 consisting of a mesh member made of resin. In an assembled state, the annular seat 98 is superposed on an inner surface of the water dispersion plate 16, specifically, on an inner surface of the seat portion 46 of the nozzle seat 28, at a position where the annular seat covers the shower holes 18-1 at the outermost periphery.

The specific shapes of the impeller 36 are shown in FIGS. 9A to 11B.

As shown in the drawings, the impeller 36 has a cylindrical fitting portion 100 at a central portion thereof, and the fitting portion 100 is fitted to the shaft portion 78 of the central portion of the lid body 42 of the impeller housing 38 (refer to FIGS. 2 and 3).

The impeller 36 is rotationally driven around the shaft portion 78 on the basis of the fitting between the shaft portion 78 and the fitting portion 100.

In addition, since the fitting portion 100 protrudes slightly further downward (in FIG. 3) than other portions, the fitting portion abuts against an inner surface of the main housing body 40 in the protruding portion, and supports the entire impeller 36 together with balls 108 to be described below during rotation.

As shown in FIGS. 9A to 11B, the impeller 36 has a large number of the vanes 102, which extend in a partial spiral shape from the center in the outer circumferential direction, at regular intervals in the circumferential direction. The vanes 102, as shown in FIGS. 11A and 11B, are provided so as to form a partial spiral shape in a direction opposite to that of the stationary vanes 70 of the spiral flow generating member 34 in a plan view.

Additionally, the impeller 36 has ball holding portions 104 in three places shifted by 120° from each other in the circumferential direction.

Figure 9A:
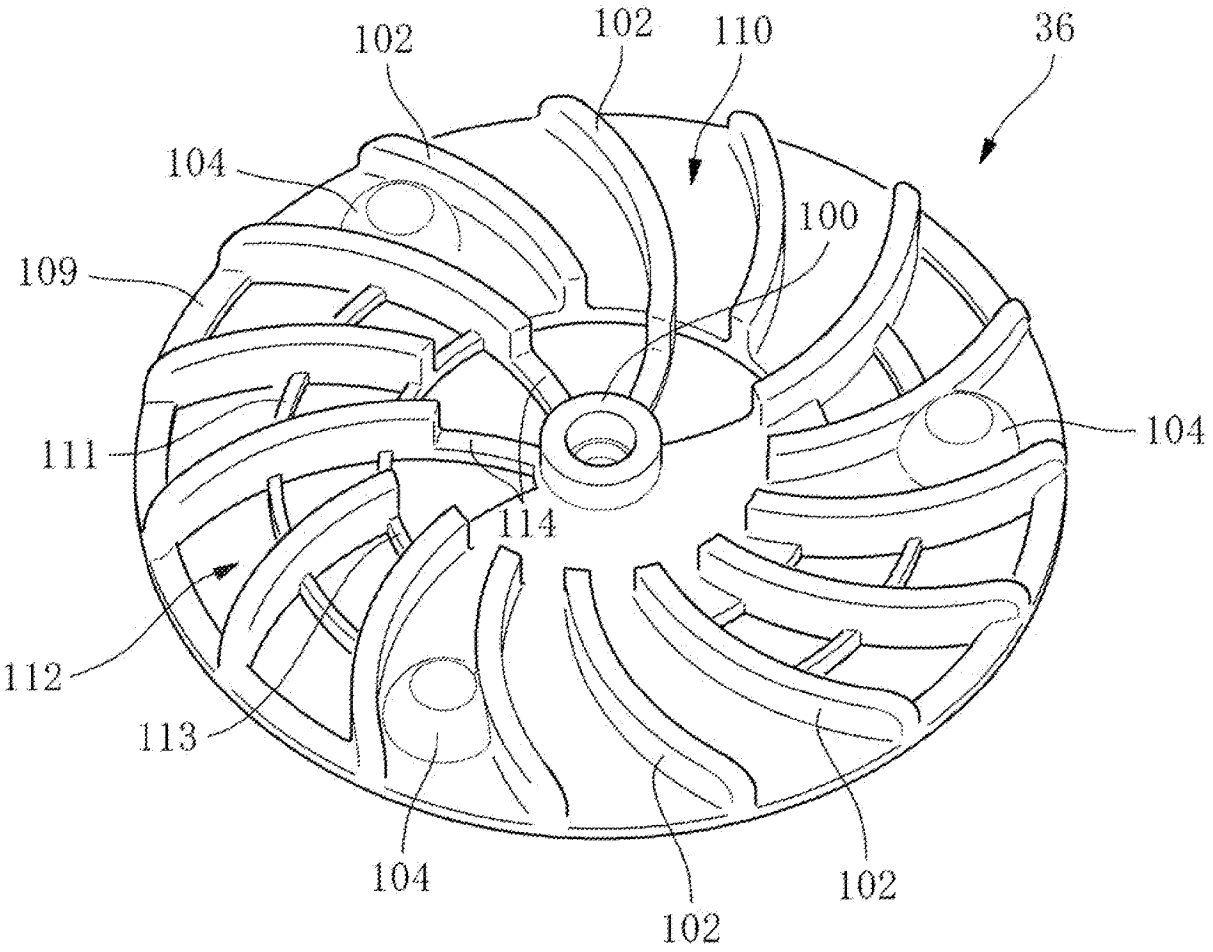
FIG. 9A is a view showing the shape of upper surface of an impeller in FIG. 6.
Figure 9B:
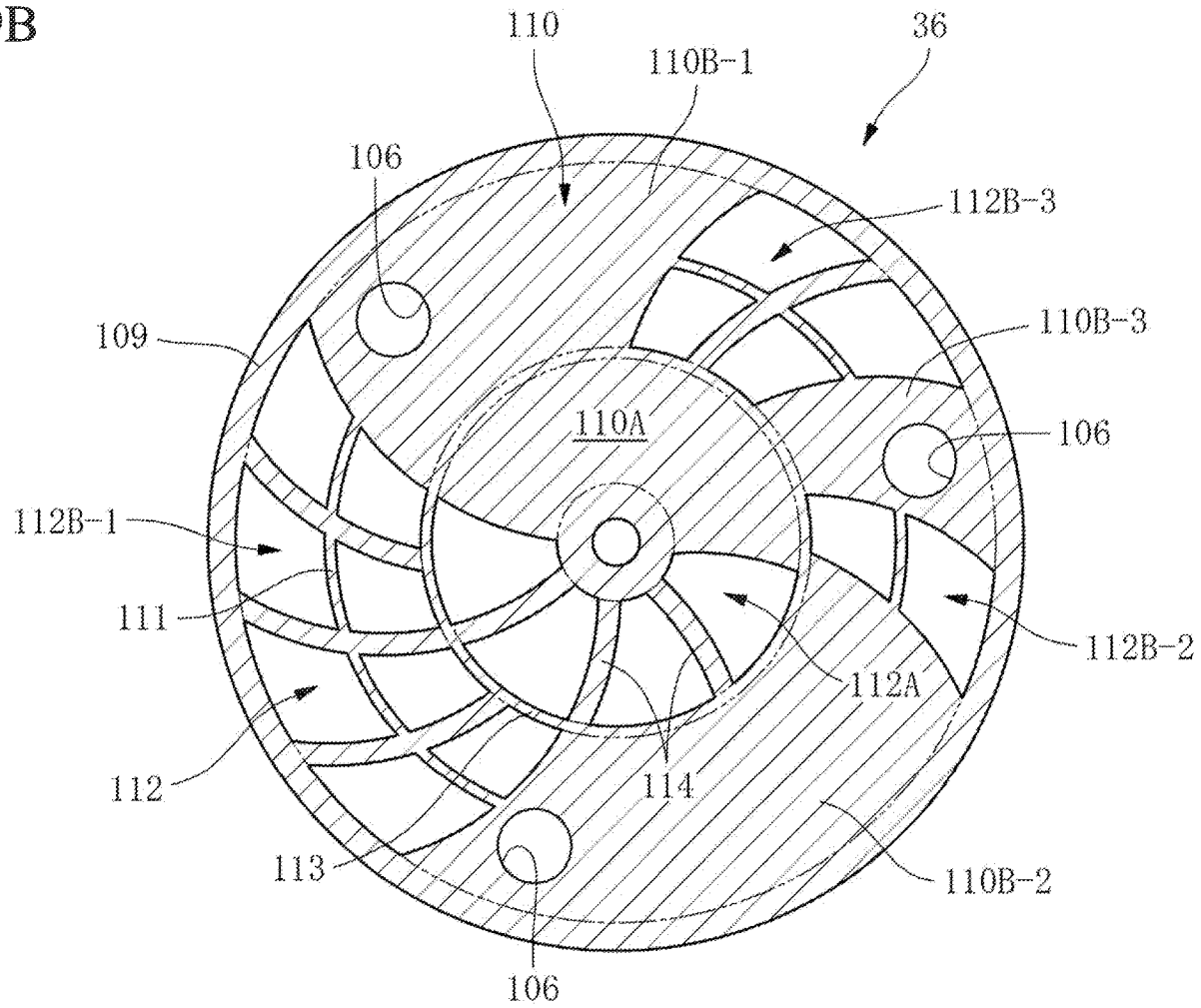
FIG. 9B is a view showing the shape of a lower surface of a bottom portion of the impeller in FIG. 6.
Figure 10A:
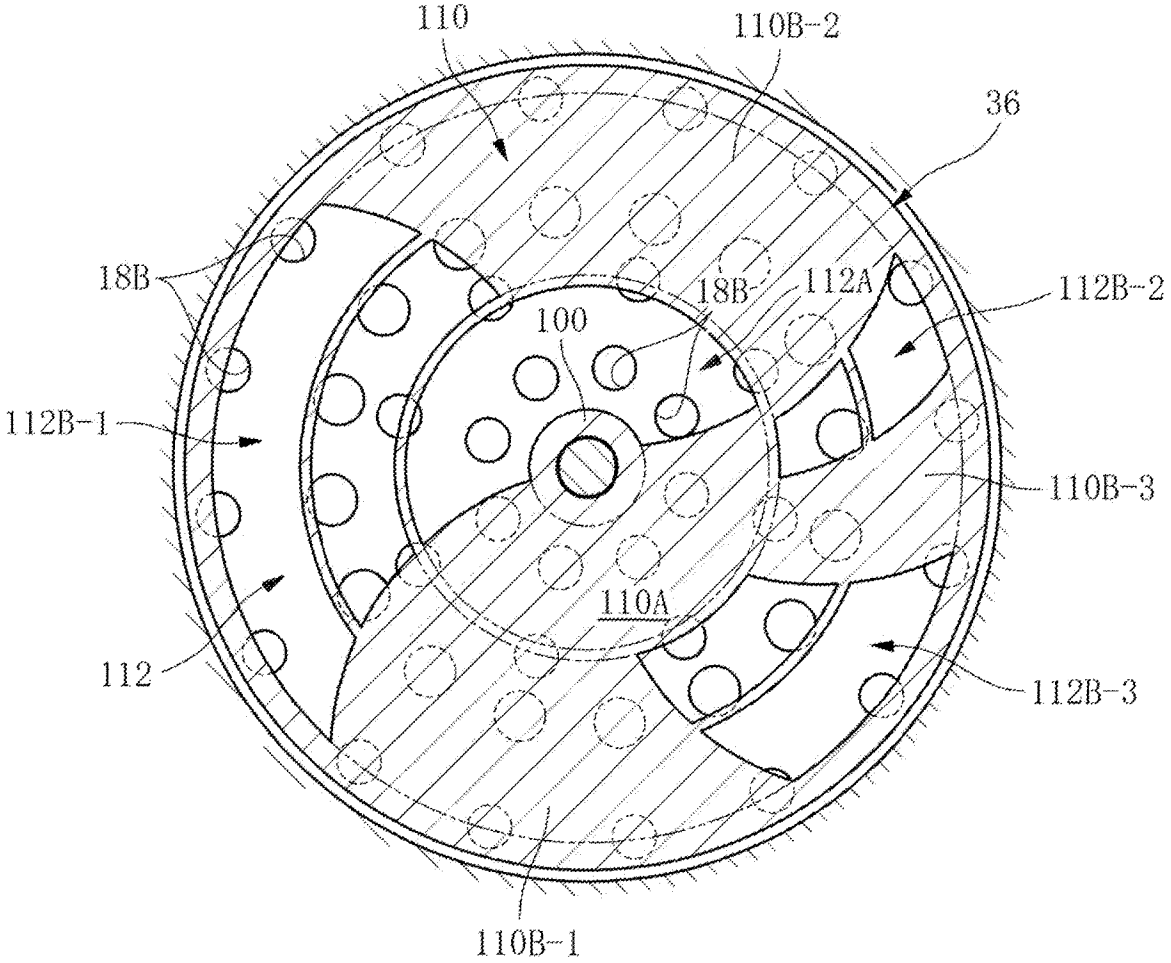
FIG. 10A is a schematic view showing a relationship between the impeller and the shower holes according to an exemplary embodiment of the invention.
Figure 10B:
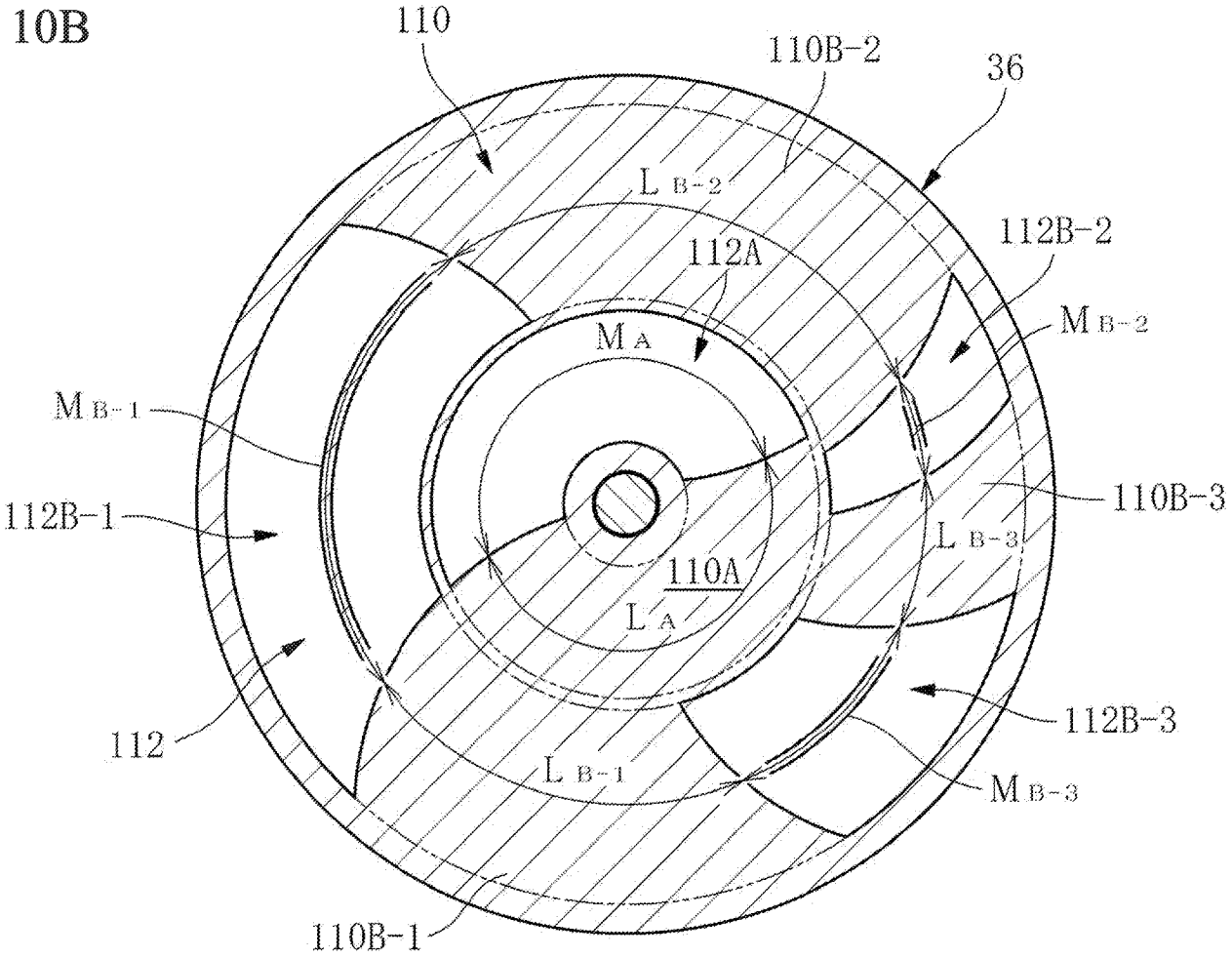
FIG. 10B is a view showing shower hole blocking portions and shower hole opening portions of the impeller according to an exemplary embodiment of the invention.

The ball holding portions 104, as shown in FIGS. 3 and 9B, have holding holes 106, respectively, and hold the hard halls 108 made of resin in the holding holes 106.

Lower portions of the balls 108 protrude slightly downward in FIG. 3 from the holding holes 106, and the balls 108 rollably abut against an inner surface of the bottom portion 48 of the main housing body 40 of the impeller housing 38 in the protruding portions.

Inner surfaces of the holding holes 106 have a substantially partial spherical shape. However, the sizes of openings of the inner surfaces and lower ends (in the drawing) of the holding holes are slightly greater than those of the balls 108.

The vanes 102 are coupled together by as rib-shaped coupling portion 109 at the outermost periphery, a rib-shaped coupling portion 111 located closer to the inner peripheral side than the coupling portion 109, a rib-shaped coupling, portion 113 located still closer to the inner peripheral side than the coupling portion 109, and shower hole blocking portions 110 to be described below.

All of the coupling portions 109, 111, and 113 have a concentric circular-arc shape.

A downstream portion of the impeller 36 is provided with the shower hole blocking portions 110 that extend in a predetermined circumference along the inner surface of the bottom portion 48 of the main housing body 40 and partially close a lower surface (in the drawing) of the impeller 36. The shower hole blocking portions 110 cover and block the communication holes 18B of the bottom portion 48, that is, the shower holes 18.

Additionally, the portions of the impeller 36 excluding the shower hole blocking portions 110 are provided with shower hole opening portions 112 that open (however, the vanes 102 and the coupling portions 109, 111, and 113 are excluded) toward the inner surface of the bottom portion 48 of the main housing body 40.

The vanes 102 located in the shower hole blocking portions 110 are provided on upper surfaces (in the drawing) of the shower hole blocking portions 110.

Some of the vanes 102 provided on the shower hole opening portions 112 are connected to the cylindrical fitting portion 100 of the central portion by arms 114 because portions thereof on a root side are formed as the arms 114.

In the present exemplary embodiment, a shower hole blocking portion at an inner peripheral portion with respect to the coupling portion 113 is only one shower hole blocking portion 110A. Meanwhile, an outer peripheral portion is farther provided with three shower hole blocking portions of shower hole blocking portions 110B-1, 110B-2, and 110B-3.

Similarly, although the shower hole opening portion at the inner peripheral portion is only one shower hole opening, portion 112A, the out peripheral portion is provided with the three shower hole opening portions of the shower hole opening portion 112B-1, 112B-2, and 112B-3.

In addition, the shower hole blocking portion 110A is provided over a semicircle (refer to FIG. 10A), and the ratio of a circumferential length $L_A$ (refer to FIG. 10B) to the whole circumferential length (circumferential length in the same circumference) is 0.5 with the whole circumferential length being 1.

The same applies to the shower hole opening portion 112A, and the ratio of a circumferential length $M_A$ of the shower hole opening portion 112A to the whole circumferential length is 0.5.

Meanwhile, the ratio of a circumferential length $L_{B\text{-}1}$ of the shower hole blocking portion 110B-1 of the outer peripheral portion to the whole circumferential length is 0.21, and the ratio of a circumferential length $L_{B\text{-}2}$ of the shower hole blocking portion 110B-2 to the whole circumferential length is 0.28. The ratio of a length obtained by summing the lengths $L_{B\text{-}1}$ and $L_{B\text{-}2}$ to the whole circumferential length is about 0.5, and is almost the same as the ratio of the circumferential length $L_A$ of the shower hole blocking portion 110A at the inner peripheral portion to the whole circumferential length.

That is, the shower hole blocking portions equivalent to half a circumference are configured so as to be distributed as the shower hole blocking portions 110B-1 and 110B-2 at the outer peripheral portion.

In addition, another shower hole blocking portion 110B-3 at the outer peripheral portion is provided mainly for the ball holding portion 104. The ratio of a circumferential length $L_{B\text{-}3}$ of the shower hole blocking portion 110B-3 to the whole circumferential length is 0.08.

In addition, the ratio of a circumferential length $M_{B\text{-}1}$ of the shower hole opening portion 112B-1 to the whole circumferential length is 0.25, the ratio of a circumferential length $M_{B\text{-}3}$ of the shower hole opening portion 112B-3 to the whole circumferential length is 0.12, and the ratio of a circumferential length $M_{B\text{-}2}$ of the shower hole opening portion 112B-2 to the whole circumferential length is 0.05.

Next, the operation of the pulse shower device of the present exemplary embodiment will be described.

In the pulse shower device of the present exemplary embodiment, the water, which has flowed into the inflow chamber 62 from the water channel 60 of FIG. 2, flows through the inflow chamber 62 in the axial direction in the downward direction in FIG. 2, and the direction of flow thereof is changed to an outward direction in the axis-perpendicular direction by the spiral flow generating member 34.

That is, the water stream in the axial direction of the central portion serves as a flow in an outward direction in the axis-perpendicular direction within the water chamber 68 of the spiral flow generating member 34. In that case, the outward flow serves as the spiral flow due to an action caused by the stationary vanes 70 of the spiral flow generating member 34.

The outward spiral flow hits the peripheral wall pardon 66 of the spiral flow generating member 34 and next flows to an inward direction in the axis-perpendicular direction, and is then sprayed through the spray ports 88 of the impeller housing 38 that serves as the water stream spraying member from the lateral side on the outer peripheral side of the impeller 36 to the impeller 16.

The sprayed water stream hits the concave surfaces of the partial spiral vanes 102 of the impeller 36 and rotates the impeller 36 while maintaining the spiral flow in the direction P of FIGS. 11A and 11B.

In detail, the impeller 36 is rotationally driven around the shaft portion 78 of the lid body 42 of the impeller housing 38. The impeller 36 is smoothly rotated around the shaft portion 78 by the bearing action obtained by the balls 108 provided in three places in the circumferential direction.

The shower hole blocking portions 110 and the shower hole opening portions 112 are rotated around the shall portion 78 by the above rotational motion. Accordingly, the shower holes 18 are blocked and opened, and water is intermittently discharged in pulses.

As described above, in the present exemplary embodiment, the number of the shower hole blocking portions 110 and the shower hole opening portions 112 that are located on the same circumference is greater at the outer peripheral portion than at the inner peripheral portion, and the time interval from the blocking of the shower holes 18 at the outer peripheral portion to the opening thereof and from the opening thereof to the closing thereof is made shorter than the time interval at the inner peripheral portion. Accordingly, a pulsating sensation of water is relaxed even in a case where the pulse shower device is enlarged, and a sensation while showering in water is prevented from deteriorating due to an excessively strong pulsating sensation of the water. Therefore, a user can be made to feel a comfortable sensation while showering in water.

Figure 12A:
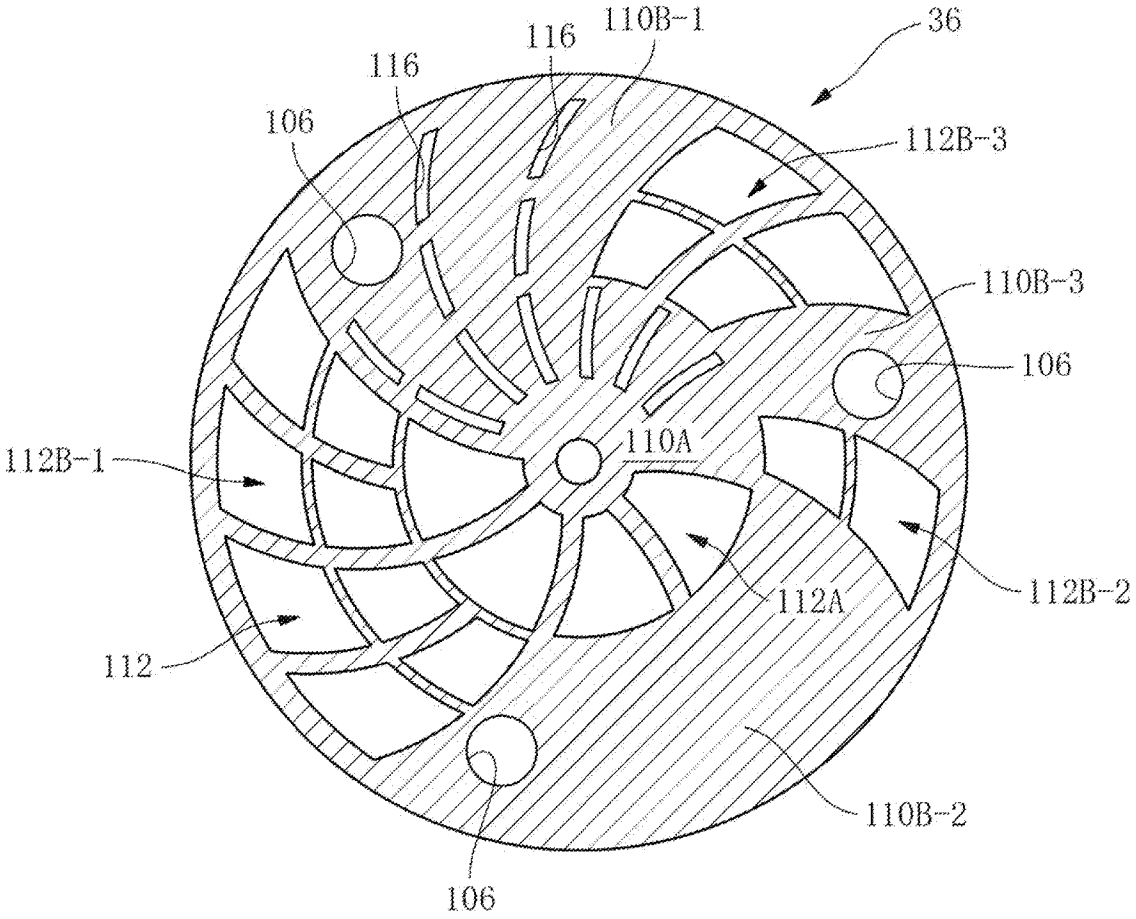
FIG. 12A is a view showing essential parts according to another exemplary embodiment of the invention.
Figure 12B:
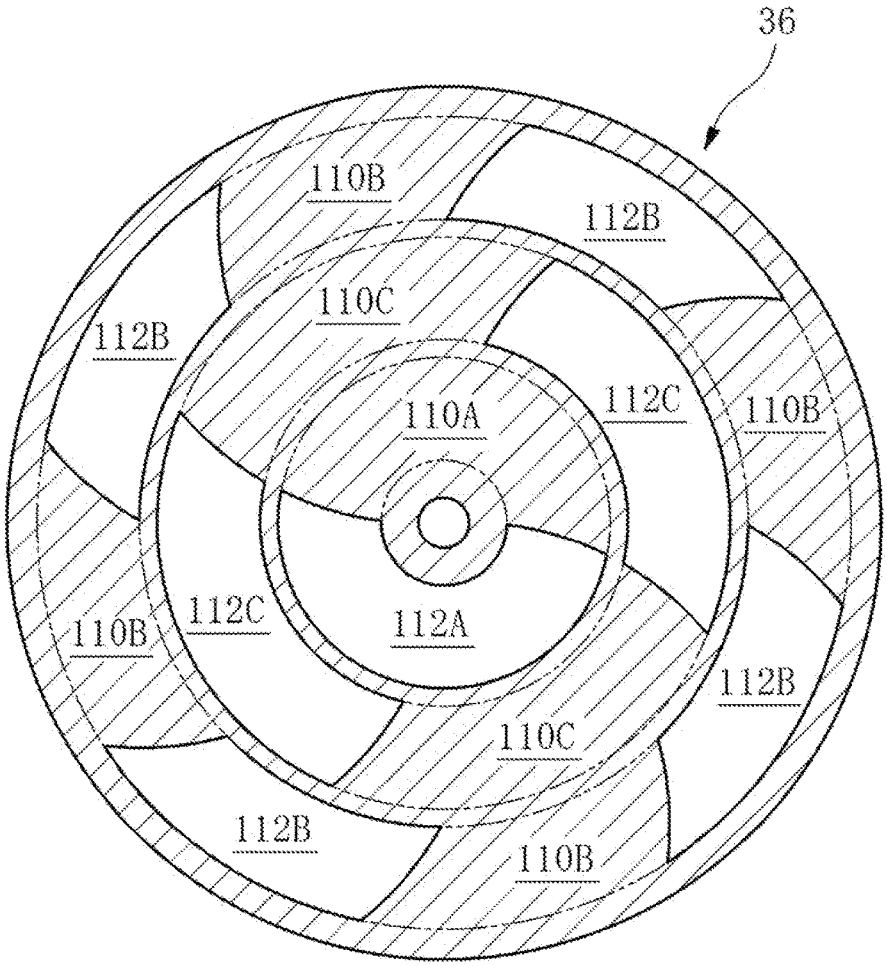
FIG. 12B is a view showing essential parts according to still another exemplary embodiment of the invention.
Figure 13A:
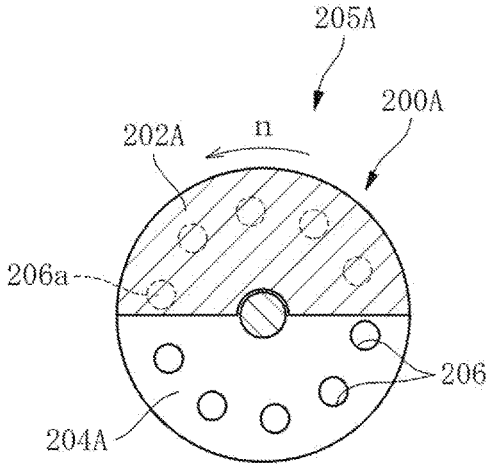
FIG. 13A is a schematic view showing related art.
Figure 13B:
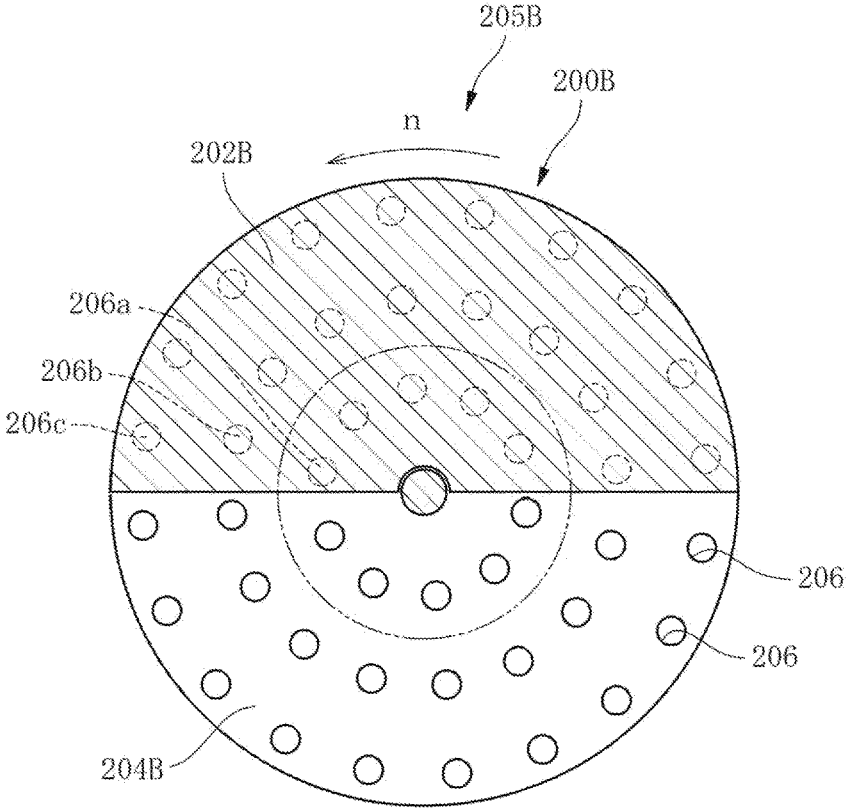
FIG. 13B is a schematic view showing related art.

FIGS. 12A and 12B show other exemplary embodiments of the invention.

FIG. 12A shows an example in which the shower hole blocking portions 110 are provided with slit holes 116 passing through the shower hole blocking portions 110 in a thickness direction.

Forces that push the shower hole blocking portions 110 downward in the water chamber 72 are applied to the shower hole blocking portions 110. Smooth rotation of the impeller 36 tends to be impaired due to downward forces that are partially applied in the circumferential direction.

Thus, in the present example, the rotation of the impeller 36 is made smooth by providing the penetrating slit holes 116 in the shower hole blocking portions 110 and relieving pressure with the slit holes 116.

Usually, since the slit holes 116 are extremely line holes in which the ratio of the circumferential length thereof to the whole circumferential length is less than 0.04, the slit holes 116 do not substantially serve as the shower hole opening portions. The ratio of the circumferential length of the shower hole blocking portions 110 and the shower hole opening portions 112 arranged on the same circumference to the whole circumferential length is equal to or higher than 0.04.

In the example described above, the impeller 36 is partitioned into two of the inner peripheral portion and the outer peripheral portion, and the number of the shower hole blocking portions and the shower opening portions is made greater at the outer peripheral portion than at the inner peripheral portion. On the other hand, as shown in FIG. 12B, it is also possible to use a configuration in which the impeller 36 is partitioned into the inner peripheral portion, the outer peripheral portion, and an intermediate portion between the inner and outer peripheral portions, the number of shower hole blocking portions 110C at the intermediate portion is made greater than at the inner peripheral portion, and the number of shower hole blocking portions 110B at the outer peripheral portion is made still greater.

In addition, the same applies to the shower hole opening portions 112, and it is also possible to use a configuration in which the number of the shower hole opening portions 112C at the intermediate portion is made greater than the number of the shower hole opening portions 112A at the innermost periphery, and the number of the shower hole opening portions 112B at the outermost periphery is made still greater.

Although the exemplary embodiment of the invention has been described in detail above, the configuration of the invention can be variously changed without departing from the scope thereof such that the shower hole blocking portions and the shower hole opening portions can be provided with numbers different from those above.

DESCRIPTION OF THE REFERENCE SYMBOLS

16: water dispersion plate
18, 18-1, 18-2, 18-3, 18-4: shower hole
36: impeller
110, 110A, 110B-1, 110B-2, 110B-3, 110C: shower hole blocking portion
112, 112A, 112B-1, 112B-2, 112B-3, 112C: shower hole opening portion

The invention claimed is:

1. A pulse shower device comprising:

a water dispersion plate that comprises an inner surface and an outer surface, and a plurality of shower holes that penetrate from the inner surface to the outer surface; and an impeller that has a disk-shape and comprises: a shower hole blocking portion that is formed over a predetermined circumferential length along the inner surface in a downstream portion of the inner surface of the water dispersion plate, and covers the plurality of shower holes; a shower hole opening portion that opens toward the inner surface; a plurality of vanes; an inner peripheral portion; and an outer peripheral portion, that is provided on an upstream portion of the inner surface of the water dispersion plate, and that rotates around an axis due to a water stream hitting the plurality of vanes, wherein the shower hole blocking portion and the shower hole opening portion are alternately arranged in a circumferential direction on the same circumference, and rotate around the axis through the rotation of the impeller to intermittently block and open the plurality of shower holes, and intermittently discharge water in pulses from the plurality of shower holes, wherein a number of shower hole blocking portions and shower hole opening portions that are arranged on the same circumference at the outer peripheral portion is greater than a number of shower hole blocking portions and shower hole opening portions at the inner peripheral portion, wherein the shower hole opening portion comprises a hole portion passing through the shower hole opening portion, wherein the shower hole blocking portion partially closes a lower surface of the impeller to block the water stream from above the impeller, and wherein the pulse shower device is configured such that a time interval between the blocking of the plurality of shower holes at the outer peripheral portion and the closing thereof and a time interval between the opening of the plurality of shower holes and the blocking thereof are shorter than a time interval between the blocking of the plurality of shower holes at the inner peripheral portion and the closing thereof and a time interval between the opening of the plurality of shower holes and the blocking thereof.

* * * * *